United States Patent [19]

Boltz

[11] Patent Number: 4,655,137

[45] Date of Patent: Apr. 7, 1987

[54] IGNITER FOR A MODEL ROCKET ENGINE

[76] Inventor: John O. Boltz, 2 Jackson Cir., Selma, Ala. 36701

[21] Appl. No.: 831,768

[22] Filed: Feb. 21, 1986

[51] Int. Cl.[4] ..... F42C 19/12

[52] U.S. Cl. ..... 102/202; 102/380

[58] Field of Search ..... 102/202, 380, 347

[56] References Cited

U.S. PATENT DOCUMENTS

| | | | |
|---|---|---|---|
| 2,462,135 | 2/1949 | Skinner | 102/202 |
| 2,627,160 | 2/1953 | MacDonald | 60/35.6 |
| 3,002,457 | 10/1961 | Doughty | 102/70.2 |
| 3,422,763 | 1/1969 | Wait | 102/202 |
| 3,741,120 | 6/1973 | McAllister | 102/34 |
| 4,370,930 | 2/1983 | Strasser | 102/530 |

*Primary Examiner*—Charles T. Jordan

*Attorney, Agent, or Firm*—Henderson & Sturm

[57] ABSTRACT

An igniter for use in conjunction with a model rocket engine. The igniter includes a housing having an adhesive ring and a fuel container. The adhesive ring supports and secures the open lower end of the rocket engine casing to the housing such that the fuel in the container is in communication with a propellant charge held in the engine casing. A pair of electrical pins extend through the base of the container and are interconnected by a nichrome wire which carries a flammable material known as an initiator. The portion of the pins extending exterior of the container are configured to be received in a standard female electrical receptacle which is connected to a battery and firing panel.

8 Claims, 3 Drawing Figures disposed to receive a quantity of fuel in communication with said propellant charge;

an electrical resistance heating element having a coating of flammable material, said heating element being disposed within said container in contact with said fuel;

a pair of electrically conductive pins, each having one end disposed within said container and an other end extending outwardly therefrom, said one ends being electrically interconnected by said heating element; and an ignition system attached to said other ends, said ignition system including means for selectively activating said heating element.

2. The igniter of claim 1 further including an adhesive coating carried on said ring, said adhesive coating being disposed to contact the lower end of said engine casing to secure said model rocket in position.

3. The igniter of claim 2 further including a non-adhesive film disposed in contact with said adhesive coating and being selectively removable therefrom.

4. The igniter of claim 1 further including a retaining cap disposed over said container whereby said fuel is prevented from spilling out.

5. The igniter of claim 1 wherein said ignition system includes a female electrical receptacle disposed to receive said pair of pins.

6. The igniter of claim 5 wherein said ignition system further includes an electrical storage battery and firing switch operably attached to said receptacle.

7. The igniter of claim 1 wherein said heating element is a nichrome wire.

8. The igniter of claim 1 wherein said flammable material is a pyrotechnic igniting composition.

* * * * *

IGNITER FOR A MODEL ROCKET ENGINE

TECHNICAL FIELD

This invention relates to igniting devices, and more particularly to electrical resistance heating actuated igniting devices for use in conjunction with model rocket engines.

BACKGROUND ART

Several types of electrically actuated igniters have been used to initiate the ignition sequence of a model rocket engine from a remote location. Typically these igniters use alligator clips to connect an electrically conductive wire or foil to a firing panel. Use of these micro clips frequently results in short circuits and results in an unreliable igniter.

Those concerned with these and other problems recognize the need for an improved igniter for model rocket engines.

DISCLOSURE OF THE INVENTION

The present invention provides an igniter for use in conjunction with a model rocket engine. The igniter includes a housing having an adhesive ring and a fuel container. The adhesive ring supports and secures the open lower end of the rocket engine casing to the housing such that the fuel in the container is in communication with a propellant charge held in the engine casing. A pair of electrical pins extend through the base of the container and are interconnected by a nichrome wire which carries a flammable material known as an initiator. The portion of the pins extending exterior of the container are configured to be received in a standard female electrical receptacle which is connected to a battery and firing panel.

An object of the present invention is the provision of an improved igniter for a model rocket engine.

Another object is to provide an igniter that virtually eliminates the problem of short circuits in the ignition system.

A further object of the invention is the provision of an igniter that is reliable.

Still another object is to provide an igniter that is easy and convenient to use.

A still further object of the present invention is the provision of an igniter that is simple in design and inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
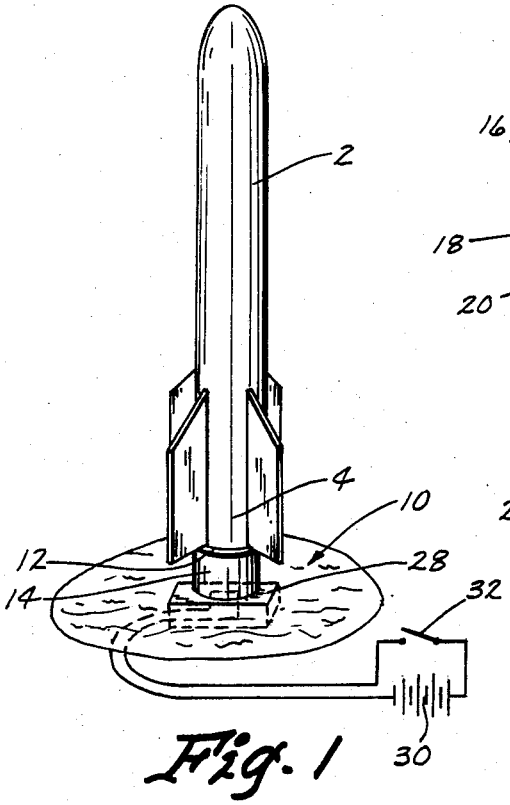
FIG. 1 is a perspective view of a model rocket supported on the igniter of the present invention together with a schematic of the electrical power source and firing switch.

Referring now to the drawings, wherein like reference numerals designate identical or corresponding parts throughout the several views, FIG. 1 shows a model rocket (2) including an open lower end (4) containing a propellant charge (not shown). The rocket (2) is supported on and adhesively secured to the electrically actuated igniter (10) of the present invention.

Figure 2:
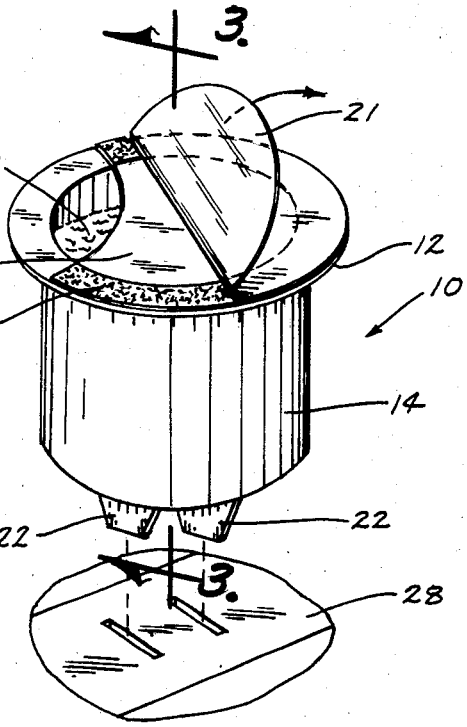
FIG. 2 is an enlarged perspective of the igniter having a portion cut away to show the rocket fuel held in the container portion of the housing.
Figure 3:
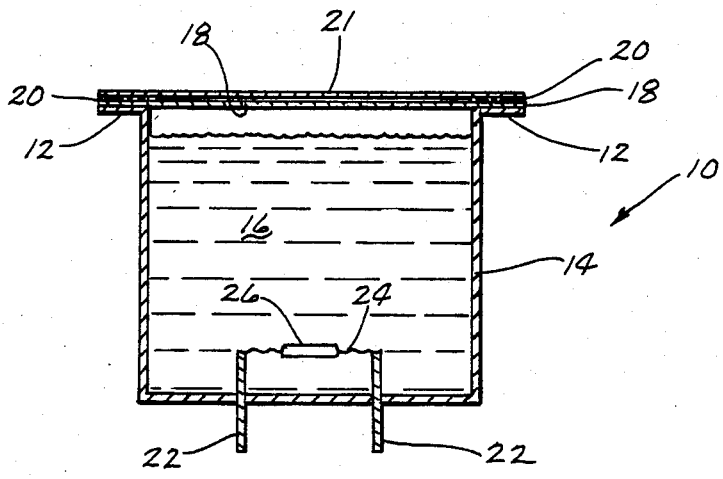
FIG. 3 is a side elevation sectional view taken along line 3—3 of FIG. 2, showing the initiator coated nichrome wire connecting the two electrical pins interior of the container.

As shown most clearly in FIGS. 2 and 3, the igniter (10) includes a housing having a ring (12) extending outwardly from an open topped container (14). The container (14) holds a small amount of rocket fuel (16). A retaining cap (18) extends over the open topped container (14) to prevent the fuel (16) from spilling out. A layer of adhesive material (20) is carried on the ring (12) and is covered by a removable non-adhesive film (21).

At the bottom of the container (14) a pair of electrically conductive pins (22) are interconnected by a nichrome wire (24) or other suitable electrical resistance heating wire. The nichrome wire (24) is coated or wrapped with a flammable material or initiator (26). The initiator (26) can be any of a number of suitable pyrotechnic igniting compositions.

As best shown in FIG. 2, the pins (22) extending exterior of the container (14) are configured to be conveniently received in a standard female electrical receptacle (28). The receptacle (28) is connected to an electrical storage battery (30) and a selectively movable firing switch (32).

The housing can be formed of any number of inexpensive, non-conductive materials such as heat resistant plastic or tightly wound paper. The receptacle (28) could also be made of a heat resistant material.

In operation, the waxed paper or non-adhesive film (21) is removed and the exposed adhesive material (20) is placed in contact with the bottom of the rocket engine casing (4) where the exhaust nozzle is located. The adhesive (20) is strong enough to hold the rocket (2) in position until the engine is ignited and kicks it off. When the rocket (2) is attached, the electrical pins (22) are simply plugged into the receptacle (28).

When the system is armed and the firing switch (32) is closed, electricity flows from the battery (30) to the igniter (10). As the nichrome wire (24) heats up, the initiator (26) ignites, which in turn ignites the rocket fuel (16) in the container (14). The burning rocket fuel (16) burns through the paper retaining cap (18) sending hot gases and burning fuel up into the nozzle of the rocket engine. When this comes in contact with the engine propellant, it will cause the engine to ignite and force the igniter (10) off and the rocket (2) will be free to ascent in flight.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. In an electrically actuated igniter for use in conjunction with a model rocket including a rocket engine casing having an open lower end containing a propellant charge, the improvement comprising:

a housing including a ring disposed to support the lower end of said engine casing; and a container